US007909181B2

(12) United States Patent
Purushothaman

(10) Patent No.: US 7,909,181 B2
(45) Date of Patent: Mar. 22, 2011

(54) ARTICLE HOLDERS

(75) Inventor: Balaji Purushothaman, Evans, GA (US)

(73) Assignee: Electrolux Home Products, Inc., Cleveland, OH (US)

( * ) Notice: Subject to any disclaimer, the term of this patent is extended or adjusted under 35 U.S.C. 154(b) by 1095 days.

(21) Appl. No.: 11/505,766

(22) Filed: Aug. 17, 2006

(65) Prior Publication Data

US 2007/0039905 A1 Feb. 22, 2007

Related U.S. Application Data

(60) Provisional application No. 60/708,860, filed on Aug. 17, 2005.

(51) Int. Cl.
*A47G 19/08* (2006.01)

(52) U.S. Cl. ..... 211/41.8

(58) Field of Classification Search ..... 211/34, 211/70.6, 41.8–41.9; D32/1–3, 25; 134/93, 134/200, 57 D, 58 D, 135; 220/488; 68/212
See application file for complete search history.

(56) References Cited

U.S. PATENT DOCUMENTS 2,710,617 A 6/1955 James et al.
2,805,777 A * 9/1957 Larson ..... 211/70.1
3,269,550 A * 8/1966 Marcus ..... 211/70.6
3,298,531 A * 1/1967 Wilcke ..... 211/70.6
4,991,722 A * 2/1991 Hight ..... 211/59.1
5,158,185 A * 10/1992 Michael et al. ..... 211/41.8
5,205,419 A * 4/1993 Purtilo ..... 211/41.8
5,480,035 A * 1/1996 Smith ..... 211/41.8
5,497,890 A * 3/1996 Clark ..... 211/41.8
5,513,910 A * 5/1996 Ellingwood et al. ..... 312/405.1
5,743,416 A 4/1998 Yemini
D431,407 S * 10/2000 Sorensen et al. ..... D6/574
6,290,075 B1 * 9/2001 Cheimets et al. ..... 211/90.03
6,546,942 B2 4/2003 Smith et al.
D516,757 S * 3/2006 Hedstrom et al. ..... D32/3
D519,303 S * 4/2006 Winig et al. ..... D6/467
7,175,031 B2 * 2/2007 Matthews ..... 211/70.6
7,216,771 B2 * 5/2007 Huish ..... 211/70.6
7,445,128 B2 * 11/2008 Kaczmarek ..... 211/41.8
2005/0028847 A1 * 2/2005 Kaczmarek ..... 134/135
2007/0119801 A1 * 5/2007 Miele et al. ..... 211/70.7

* cited by examiner

*Primary Examiner* — Sarah Purol
(74) *Attorney, Agent, or Firm* — Alston & Bird LLP

(57) ABSTRACT

An article holder for a dishwasher rack includes a first article support portion and a second article support portion connected to the first article portion and extending at an angle with respect to the first article support portion. The article holder further comprises a first mounting structure configured to engage a portion of a dishwasher rack to allow the first article support portion to support articles in a first orientation with respect to a dishwasher rack. The article holder still further comprises a second mounting structure spaced from the first mounting structure and configured to engage a portion of a dishwasher rack to allow the second article support portion to support articles in a second orientation with respect to a dishwasher rack.

16 Claims, 4 Drawing Sheets

ARTICLE HOLDERS

CROSS-REFERENCE TO RELATED APPLICATION

The present invention claims the benefit of U.S. Provisional Application No. 60/708,860 filed Aug. 17, 2005, the entire disclosure which is herein incorporated by reference.

FIELD OF THE INVENTION

The present invention relates to article holders and more particularly to article holders for a dishwasher.

BACKGROUND OF THE INVENTION

Conventional dishwashers typically include dishwasher racks adapted to support articles during a dishwashing cycle. For example, conventional racks may support pots, pans, plates, bowls, utensils, glassware, drinking vessels (e.g., cups, mugs, glasses, stemware) or other kitchenware. Dishwasher racks are known to include conventional shelves to provide alternative support for articles within an interior area of a dishwasher. There is a need for article holders to provide alternative support portions within the interior area of a dishwasher.

SUMMARY OF THE INVENTION

It is an aspect of the present invention to provide article holders for supporting articles within the interior area of a dishwasher.

In accordance with one aspect, an article holder for a dishwasher rack is provided. The article holder comprises a first article support portion and a second article support portion connected to the first article portion and extending at an angle with respect to the first article support portion. The article holder further comprises a first mounting structure configured to engage a portion of a dishwasher rack to allow the first article support portion to support articles in a first orientation with respect to a dishwasher rack. The article holder still further comprises a second mounting structure spaced from the first mounting structure and configured to engage a portion of a dishwasher rack to allow the second article support portion to support articles in a second orientation with respect to a dishwasher rack.

In accordance another aspect a dishwasher rack assembly is provided. The dishwasher rack assembly comprises a dishwasher rack including a side wall with a first portion and a second portion. The dishwasher rack assembly further comprises at least one article holder comprising a first article support portion and a second article support portion connected to the first article portion and extending at an angle with respect to the first article support portion. The article holder further includes a first mounting structure engaging the first portion of the side wall to position the article holder in a first orientation. In the first orientation, the second article support portion extends along and engages the side wall and the first article support portion extends away from the side wall for supporting articles with respect to the dishwasher rack. The article holder further comprises a second mounting structure configured to engage the second portion of the dishwasher rack to allow the article holder to be positioned in a second orientation. In the second orientation, the first article support portion extends along the side wall and the second article support portion extends away from the side wall for supporting articles with respect to the dishwasher rack.

In accordance still another aspect a dishwasher rack assembly is provided. The dishwasher rack assembly includes a dishwasher rack with a side wall including a first portion and a second portion. The dishwasher rack assembly further includes at least one article holder comprising a first article support portion including a first substantially planar sheet of material with a first set of article receiving apertures. The article holder further includes a second article support portion including a second substantially planar sheet of material with a second set of article receiving apertures. The first planar sheet of material is connected to the second planar sheet of material with the second planar sheet of material extending at an angle from about 90° to about 135° with respect to the first planar sheet of material. The article holder further includes a first mounting structure engaging the first portion of the side wall to position the article holder in a first orientation. In the first orientation, the second planar sheet of material extends along and engages the side wall and the first planar sheet of material extends away from the side wall with the first set of article receiving apertures positioned for supporting articles with respect to the dishwasher rack. The article holder still further includes a second mounting structure configured to engage the second portion of the dishwasher rack to allow the article holder to be positioned in a second orientation. In the second orientation, the first planar sheet of material extends along the side wall and the second planar sheet of material extends away from the side wall with the second set of article receiving apertures positioned for supporting articles with respect to the dishwasher rack.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
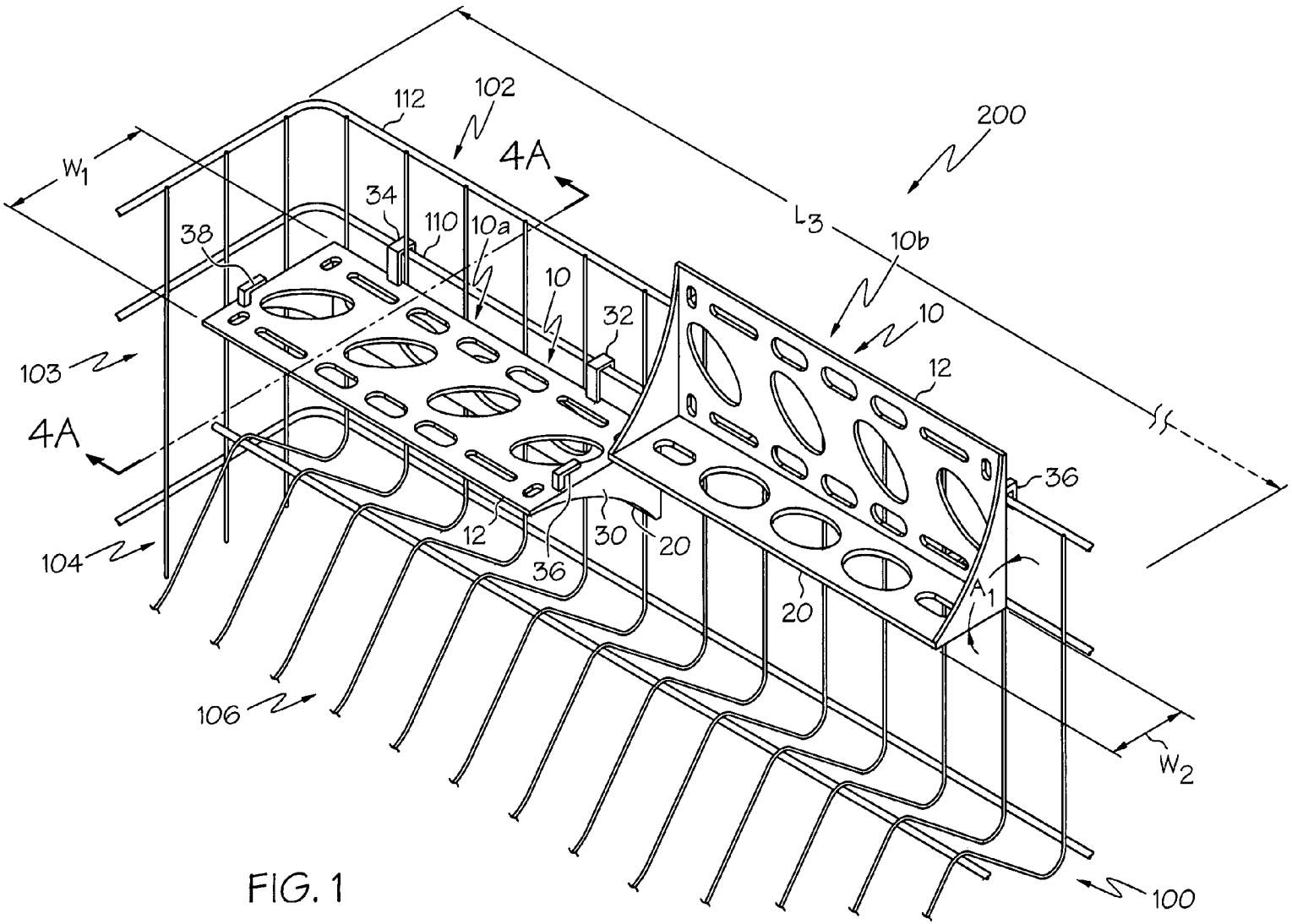
FIG. 1 is a perspective view of an example dishwasher rack assembly incorporating aspects of the present invention.

Certain terminology is used herein for convenience only and is not to be taken as a limitation on the present invention. Further, in the drawings, the same reference numerals are employed for designating the same elements.

FIG. 1 depicts one example of a dishwasher rack assembly 200 that may be used in a wide variety of ways before, during and/or after the dishwashing cycle. The dishwasher rack assembly 200 can include a dishwasher rack 100 configured to receive and support a wide range of articles. For example, the dishwasher rack 100 may be designed to receive and support articles such as pots, pans, plates, bowls, utensils (e.g., knives, forks, spoons, spatulas, ladles, etc.), glassware, drinking vessels (e.g., cups, mugs, glasses, stemware, etc.) or the like. The dishwasher rack 100 not only receives and supports the above-referenced articles, but permits cleaning and rinsing fluids to pass through the dishwasher rack 100 during a dishwashing procedure. Although not required in all examples, the dishwasher rack 100 may comprise a plurality of elongated members (e.g., wires) to permit passage of cleaning and rinsing fluids while maintaining a shape for receiving and supporting the articles.

The dishwasher rack 100 can include a wide range of configurations to receive and support articles and facilitate passage of cleaning and rinsing fluids during the dishwashing procedure. In one example, the dishwasher rack 100 can include a base 106 and a side wall 102 extending away from the base 106. The side wall 102 include a length "$L_3$" extending in a direction along the base 106 of the dishwasher rack 100. Optionally, the dishwasher rack 100 can also include one or more further side walls in addition to the side wall 102. In the illustrated example, the dishwasher rack 100 includes four side walls including the side wall 102 and another side wall 103 partially shown in FIG. 1. As further illustrated in FIG. 1, the side walls 102, 103 are located at approximately 90° with respect to one another although other angles may be employed in further embodiments incorporating aspects of the invention. For example, each side of a four-sided dishwasher rack may be located at approximately 90° with respect to an adjacent side wall to form a rectangular shaped dishwasher rack 100 defining an interior area 104. In further examples, sides of the dishwasher rack may be located at other angles with respect to an adjacent side wall to obtain alternative dishwasher rack configurations.

To further support articles, such as articles mentioned above, one or more article holders may be provided to increase the capability of supporting such articles. The article holders herein may be formed by a wide variety of materials and methods. In one example, the article holders are formed by an injection molding or forming process. It is also contemplated that the article holders may be formed from a metal (e.g., aluminum, stainless steel), plastic (e.g., polypropylene, etc.), resin, composite material or other material type capable of supporting articles within a dishwasher environment.

The figures illustrate an example of an article holder 10 for a dishwasher rack 100 in accordance with aspects of the present invention. The article holder 10 can include a first article support portion 12 and a second article support portion 20. The first and second article support portion may comprise a wide variety of configurations and shapes. In the illustrated example, the first and second article support portions 12, 20 comprise a substantially planar sheet of material. In further examples, one or more of the article support portions may comprise nonplanar material or may comprise a grill, lattice, framework or other configuration designed to support articles. In one example, one or both of the article support portions may define a receptacle designed to hold articles therein. Example receptacles may comprise a basket (e.g., silverware basket), tray, clips, article inserts (e.g., designed to be inserted into an interior portion of an article) or the like.

One or both of the article support portions may also include a plurality of article receiving apertures. For example, as shown both the first and second article support portions 12, 20 include article receiving apertures. Providing article receiving apertures, for example, may allow supporting articles (e.g., utensils) in a vertical orientation. Supporting the articles in a vertical orientation can increase the number of utensils capable of being supported by the holder at one time. Further, the upright position of the utensils can facilitate draining of wash water from the utensils, thus potentially reducing undesirable water spots created during drying. Even further, the apertures can inhibit, such as prevent, utensils from sliding or falling off of the article support portion and onto the heating coils of the dishwasher during the wash cycle.

Figure 2:
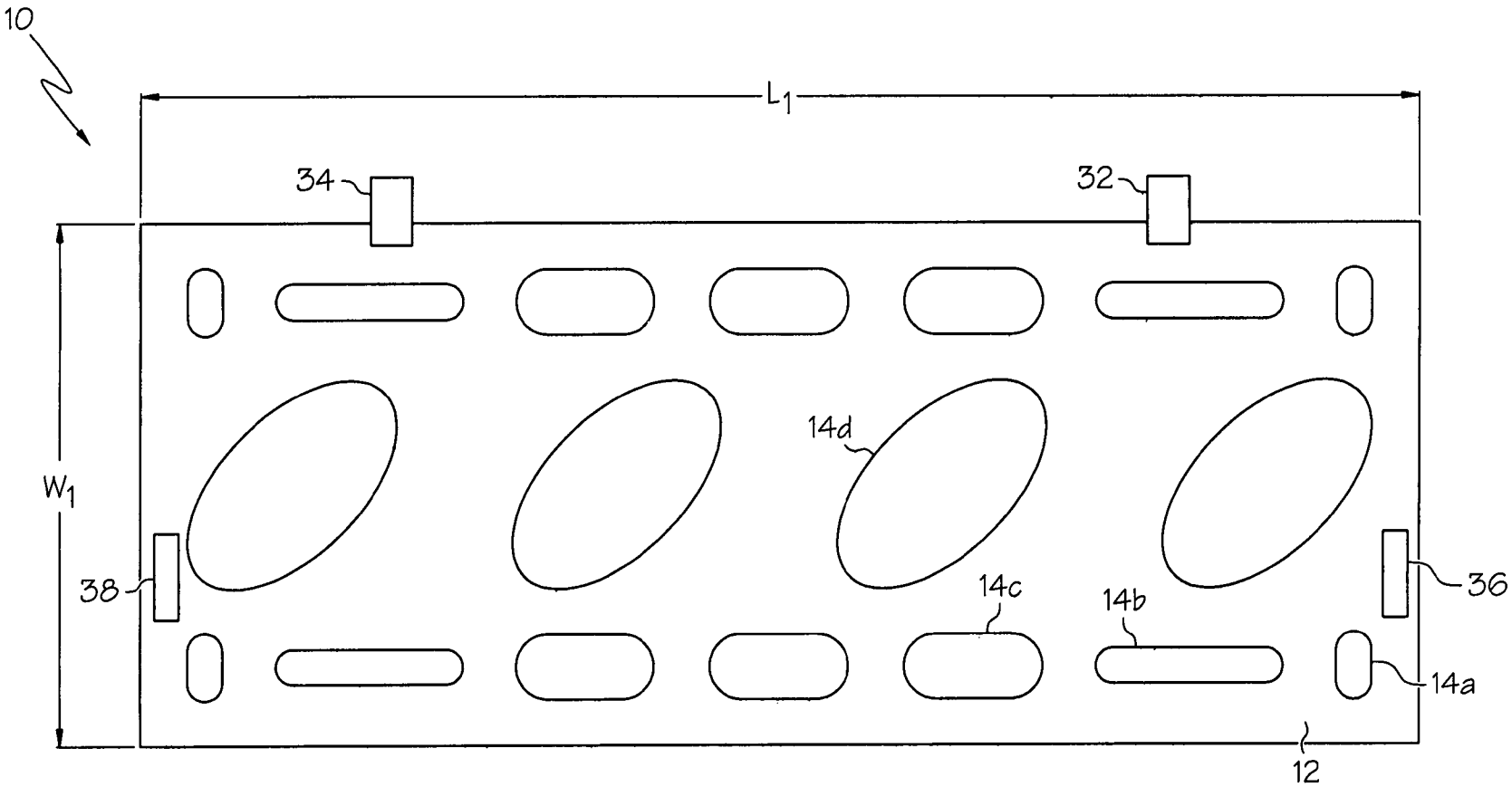
FIG. 2 is a top view of an article holder in accordance with an example of the present invention.
Figure 3:
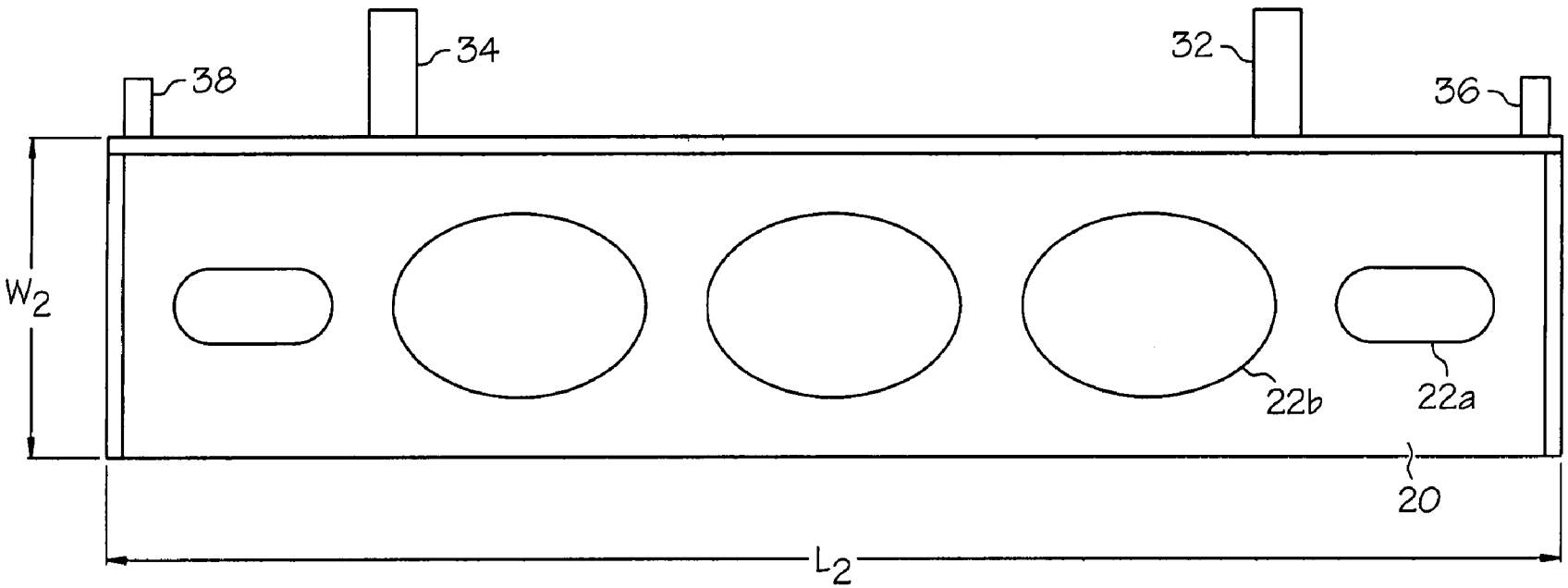
FIG. 3 is a front view of the article holder of FIG. 2.

As shown in FIG. 2, the first article support portion 12 comprises a plurality of article receiving apertures 14*a*, 14*b*, 14*c*, 14*d*. Likewise, as shown in FIG. 3, the second article support portion 20 includes a plurality of apertures 22*a*, 22*b*. Article receiving apertures may comprise a variety of shapes and sizes and may be arranged in different patterns. In some examples, one aperture type may be provided by the first article support portion and a second aperture type may be provided by the second article support portion. For instance, larger apertures may be provided by the first article support portion to accommodate larger articles (e.g., utensils) while smaller apertures may be provided on the second article support portion to accommodate smaller articles (e.g., utensils). Thus, by switching orientations of the article holder, a consumer may select from at least two different article receiving aperture types. Alternatively, as shown, the article receiving apertures 14*a*, 14*b*, 14*c* and 22*a* comprise various shaped oblong enclosed apertures while article receiving apertures 14*d* and 22*b* comprise oval shaped enclosed apertures. In further examples, the apertures may comprise other shapes such as circular, square, triangular, or other geometric or curvilinear shape. Still further, although the article receiving apertures are shown as enclosed apertures, it is contemplated that the apertures may be open to one edge of the article support portion. For example, one or more of the article receiving apertures may comprise a slot that is open to an edge of the article support portion to support the stem of stemware hanging in an inverted fashion with respect to the article support portion.

Figure 4B:
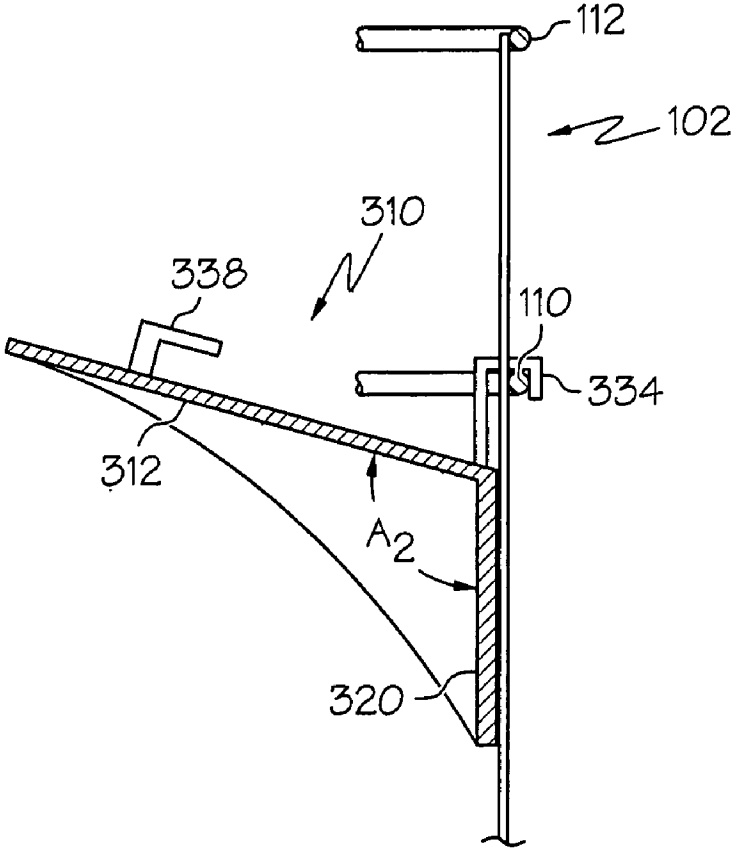
FIG. 4B is a sectional view of portions of another example of a dishwasher rack assembly incorporating aspects of the present invention.
Figure 4A:
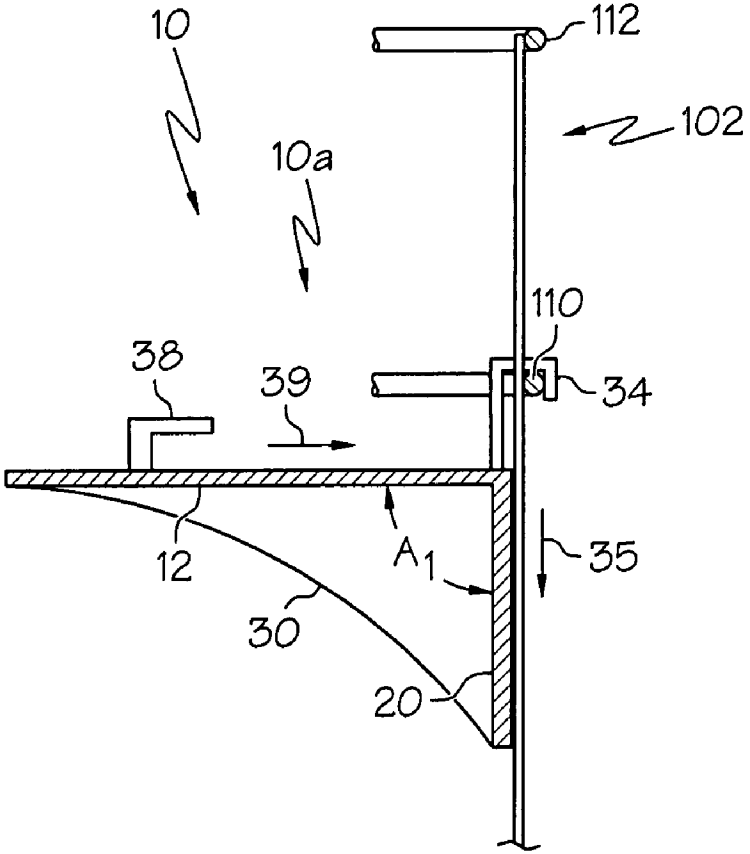
FIG. 4A is a sectional view of portions of the dishwasher rack assembly along line 4A-4A of FIG. 1.

The second article support portion 20 can be connected to the first article support portion 12 at an angle with respect to the first article support portion 12. In one example, the angle of the second article support portion with respect to the first article support portion is less than 180°. In another example, the angle of the second article support portion with respect to the first article support portion is from about 90° to less than 180°. For instance, as shown in FIG. 4A, the angle $A_1$ of the second article support portion 20 with respect to the first article support portion 12 is about 90°. Providing an angle of about 90° can be beneficial to allow the first and second article support portion to extend approximately perpendicular to the side wall 102. Indeed, as shown in FIG. 1, in a first orientation 10*a*, the first article support portion 12 extends approximately 90° from the side wall 102 of the dishwasher rack 100. Similarly, in a second orientation 10*b*, the second article support portion 20 extends approximately 90° from the side wall 102 of the dishwasher rack 100. In still further examples, the angle of the second article support portion with respect to the first article support portion is from about 90° to about 135°. In yet another example, the angle of the second article support portion with respect to the first article support portion is from about 100° to about 120°. For example, as shown in FIG. 4B, the angle $A_2$ of the second article support portion 320 with respect to the first article support portion 312 of an article holder 310 is about 105°. Providing an angle between the second article support portion and the first article support portion of greater than 90° can be beneficial to allow the first article support portion to act as a shelf. Indeed, as shown in FIG. 4B the first article support portion 312 is located at an acute angle with respect to the side wall 102 of the dishwasher rack 100. It will therefore be appreciated that, due to gravity, glasses or other articles placed on the first article support portion 312 will tend to propagate toward the side wall 102 and abut the side wall 102 rather than fall of an opposed edge of the first article support portion 312. Still further, during the dishwashing cycle, such as the drying cycle, the article holder 310 may be required to endure an increased temperature.

Increased temperature may cause temporary sagging of the first article support portion 312 with respect to the second article support portion 320. However, as the angle $A_2$ is greater than 90°, the increased angle can offset any adverse effects of sagging of the first article support portion 312 during increased temperature conditions. Thus, articles supported on the first article support portion 312 will continue to propagate toward the side wall 102 without sliding off the opposed end of the first article support portion 312.

The second article support portion 20 can be connected to the first article support portion 12 in a wide variety of ways. For example, the second article support portion may be integrally connected to the first article support portion by being integrally formed together during an injection molding process, forming process, or other fabrication technique. In further examples, the second article support portion may be integrally connected to the first article support portion by sonic welding, adhesive, or other process. Furthermore, the second article support portion may be nonintegrally connected to the first article support portion in further examples. For instance, the second and first article support portions may be interlocked together. In further examples, a brace, angle or other connection may be used to connect the second article support portion to the first article support portion. In addition, optional bracing structures may be provided to increase the structural integrity of the article holder 10. For example, as shown, the article holder 10 may include side braces 30 extending between the first and second article support portions 12, 20 to inhibit relative bending and/or increase the structural integrity of the article holder 10.

The article holder 10 can also include a first mounting structure configured to engage a portion of the dishwasher rack 100 to allow the first article support portion 12 to support articles in the first orientation 10*a* with respect to the dishwasher rack 100. For example, the first mounting structure can comprise a first pair of engagement hooks 32, 34 configured to simultaneously engage a first horizontal rung 110 of the dishwasher rack. Indeed, as shown in FIGS. 1 and 4A, in the first orientation 10*a*, the first pair of engagement hooks 32, 34 are configured to simultaneously engage the first horizontal rung 110 while the second article support portion 20 extends along and engages the side wall 102 of the dishwasher rack 100. Thus, the pair of the engagement hooks 32, 34, together with the engagement of the second article support portion 20 with the side wall 102, allows the first article support portion 12 to extend away from the side wall 102 to provide support for articles. As shown further shown in FIG. 4A, the first pair of engagement hooks 32, 34 can be open in a first direction 35 extending substantially parallel to the second article support portion 20 to facilitate hanging of the engagement hooks 32, 34 from the first horizontal rung 110. Likewise, as shown in FIG. 4B, the first pair of engagement hooks (see 334 in FIG. 4B) can also extend in a first direction substantially parallel to the second article support portion 320.

The article holder 10 can also include a second mounting structure configured to engage a portion of the dishwasher rack 100 to allow the second article support portion 20 to support articles in the second orientation 10*b* with respect to the dishwasher rack 100. For example, the second mounting structure can comprise a second pair of engagement hooks 36, 38 configured to simultaneously engage a second horizontal rung 112 of the dishwasher rack 100. Indeed, as shown in FIG. 1, in the second orientation 10*b*, the second pair of engagement hooks 36,38 are configured to simultaneously engage the second horizontal rung 112 while the first article support portion 10 extends along and can engage the side wall 102 of the dishwasher rack 100. Thus, the second pair of the engagement hooks 36, 38, together with the engagement of the first article support portion 10 with the side wall 102 (or the juncture between the first and second article support portion), allows the second article support portion 20 to extend away from the side wall 102 to provide support for articles. Although not required, as shown, the first pair of engagement hooks 32, 34 may also be designed to engage the first horizontal rung 110 in the second orientation 10*b*. As shown further shown in FIG. 4A, the second pair of engagement hooks 36, 38 can be open in a second direction 39 extending substantially parallel to the first article support portion 12 to facilitate hanging of the engagement hooks 36, 38 from the second horizontal rung 112. Likewise, as shown in FIG. 4B, the second pair of engagement hooks (see 338 in FIG. 4B) can also extend in a second direction substantially parallel to the first article support portion 312.

Although not required, the first and second mounting structure of the article holder may be both attached to the first article support portion. For example, as shown the first pair of engagement hooks 32, 34 and the second pair of engagement hooks 36, 38 are both attached to the first article support portion 12. Moreover, if provided with two pairs of hooks, the first pair of engagement hooks 32, 34 can be open in the direction 35 extending substantially parallel to the second article support portion 20 and the second pair of engagement hooks 36, 38 can be open in the direction 39 extending substantially parallel to the first article support portion 12.

It is contemplated that either pair of engagement hooks may be designed to engage any horizontal rung of the side wall 102. For example, the first pair of engagement hooks 32, 34 may be engaged with the second horizontal rung 112 to hang longer articles by way of the article receiving apertures 14*a*, 14*b*, 14*c*, 14*d*. In another example, the second pair of engagement hooks 36, 38 may be engaged with the first horizontal rung 110 to lower the article holder 10. Moreover, although the first and second mounting structures are illustrated as pairs of engagement hooks, it is contemplated that a single engagement hook or more than two engagement hooks for each mounting structure may be used. Furthermore, other mounting structures may be used in still further examples. For instance, a clip, interlock structure, or other arrangement may be used to engage horizontal and/or vertical rungs of the dishwasher rack. Brackets, fasteners, clamps and/or other arrangements may also be used for one or both of the mounting structures in further examples. Providing hooks, however, may be beneficial to allow the article holder to be quickly removed from the dishwasher rack, quickly switched between first and second orientations 10*a*, 10*b*, quickly repositioned at different elevations of the side wall, and/or be quickly repositioned between different side walls of the dishwasher rack.

The first and second article support portion 12, 20 can have similar or different widths depending on the preferences of the consumer. For example, although not shown, it is contemplated that the first and second article support portions 12, 20 may have the same width. In such embodiments, the article holder may be moved between the first and second orientation to provide alternate article support characteristics. In still further examples, the first and second article support portions 12, 20 may have different widths. For example, as shown, the first article support portion 12 can extend a first width $W_1$ that is larger than a second width $W_2$ of the second article support portion 20. Providing different widths can provide a multifunctioning article holder 10 that can be used to support articles while also accommodating other items being supported by the dishwasher rack. For example, the article holder 10 may be positioned in the first orientation 10*a* such that the first article support portion 12 extends at a larger width $W_1$ in instances the extra extension of the first article support portion 12 does not interfere with items supported within the dishwasher rack 100. Alternatively, the article holder 10 may be positioned in the second orientation 10*b* such that the second article support portion 20 extends at a smaller width $W_2$ in instances where additional space is needed to support items in the dishwasher rack.

Although not required, the illustrated first and second article support portions 12, 20 are both configured to support articles (e.g., utensils) in a substantially vertical orientation. Due to the larger width $W_1$ of the first article support portion 12, more article receiving apertures 14*a*, 14*b*, 14*c*, 14*d* can be formed in the first article support portion 12 to permit a relatively larger number of articles (e.g., utensils) to be supported by the first article support portion 12 when compared to the articles (e.g., utensils) capable of being supported by the article receiving apertures 20*a*, 20*b* of the second article support portion 20.

As shown in FIGS. 1-3, the first article support portion 12 can have a length $L_1$ and the second article support portion 20 can have a length $L_2$ that is substantially the same length as the length $L_1$. Providing the first and second article support portion 12, 20 with lengths $L_1$, $L_2$ that are substantially the same can maximize the support capabilities of the article holder 10. Although not shown, it is also contemplated that the first and second article support portion may have different lengths. For example, the length $L_1$ of the first article support portion 12 can be less than the length $L_2$ of the second article support portion 20. In further examples, length $L_2$ of the second article support portion 20 can be less than the length $L_1$ of the first article support portion 12. In such examples, the article holder may be oriented in one orientation such that the article support portion with the longer length extends from the side wall 102 of the dishwasher rack 12 to maximize the usable area available to support articles. On the other hand, if less area is necessary to support articles, the article holder may be oriented in another orientation such that the article support portion with the shorter length extends from the side wall 102 of the dishwasher rack 12. Orienting the article support portion with the shorter length may be desirable to provide additional room for supporting items within the interior area 104 of the dishwasher rack 100 while orienting the article support portion with the longer length may be desirable in situations where additional room in the interior area 104 of the dishwasher rack 100 is not necessary.

Example methods of installing the article holder 10 to the dishwasher rack 100 to form a dishwasher rack assembly 200 will now be described. In one example, the article holder 10 may be positioned in the first orientation 10*a* by engaging the first pair of hooks 32, 34 with either the first or second horizontal rung 110, 112 such that the first article support portion 12 extends away from the side wall 102 and the second article support portion 20 engages the side wall 102. If the first pair of hooks 32, 34 are engaged with the first horizontal rung 110, the article holder 10 can support utensils in the vertical orientation while also supporting beverage containers in an upside-down position. In such an example, portions of the utensils may be received in the interior of the inverted beverage containers to increase space for articles loaded in the dishwasher. Moreover, since the first pair of hooks 32, 34 are engaged with the lower, first horizontal rung 110, a receiving area is formed for articles wherein portions of the articles (e.g., beverage containers) may rest on the top surface of the first article support portion 12 while also resting against the side wall 102 extending above the first article support portion 12. Furthermore, in addition or alternatively, utensils may be supported lengthwise along the length $L_1$ of the first article support portion 12. On the other hand, if the hooks 32, 34 are engaged with the second horizontal rung 112, the area available underneath the first article support portion 12 is increased; thereby, allowing the article holder 10 to support longer utensils and/or provide increased loading space for the dishwasher rack underneath the article holder 10.

In a further example, the article holder 10 may be moved from the first orientation 10*a* to the second orientation 10*b* with the second article support portion 20 extending away from the side wall 102 by engaging the second pair of hooks 36, 38 with either the first or second horizontal rung 110, 112 with the first article support portion 12 extending along the side wall 102. In such an example, the first article support portion 12 may also engage the side wall 102 or the junction between the first and second article support portions 12, 20 may engage the side wall 102 to help orient the second article support portion 20 to extend away from the side wall 102. Providing the article holder 10 in the second orientation 10*b* may be desirable to increase the lateral loading area of the dishwasher rack 100.

Various article holders may be used in accordance with aspects of the present invention. Article holders, for example, may be provided in various shapes and sizes and may be used individually and/or used together as a plurality of article holders. If a plurality of article holders are used (e.g., a pair of article holders), the article holders may be positioned along the same side wall or different side walls at the same or different elevations. In one example, a plurality of article holders may be positioned adjacent one another to increase the overall effective length of the article holders. Providing a single or a plurality of article holders can allow a consumer to customize the dishwasher rack area to provide a desirable loading configuration. Moreover, if a plurality of article holders are employed, one or more of the article holders may be positioned in different orientations to different article types within the dishwasher rack. Still further, if a plurality of article holders are employed, the article holders may be substantially identical or different from one another. In the illustrated example shown in FIG. 1, the dishwasher rack assembly 200 includes article holders 10 that are substantially identical to one another. It will be appreciated that the article holders may be designed for mounting on any side wall of a dishwasher rack. Therefore, depending on desired loading arrangement, the article holder can be positioned in the optimum location for increasing the overall loading space of the dishwasher rack.

From the above description of the invention, those skilled in the art will perceive improvements, changes and modifications. Such improvements, changes and modifications within the skill of the art are intended to be covered by the appended claims.

What is claimed:

1. An article holder for a dishwasher rack, the dishwasher rack includes a side wall with a first portion and a second portion, the article holder comprising:

a first article support portion;

a second article support portion connected to the first article portion and extending at an angle with respect to the first article support portion;

a first mounting structure configured to engage the first portion of the dishwasher rack to allow the first article support portion to support articles in a first orientation with respect to the dishwasher rack; and a second mounting structure spaced from the first mounting structure and configured to engage the second portion of the dishwasher rack to allow the second article support portion to support articles in a second orientation with respect to the dishwasher rack.

2. The article holder of claim 1, wherein the first article support portion comprises a first substantially planar sheet of material, and the second article support portion comprises a second substantially planar sheet of material.

3. The article holder of claim 2, wherein each planar sheet of material includes a plurality of article receiving apertures.

4. The article holder of claim 1, wherein the angle of the second article support portion with respect to the first article support portion is less than 180°.

5. The article holder of claim 1, wherein the angle of the second article support portion with respect to the first article support portion is from about 90° to less than 180°.

6. The article holder of claim 1, wherein the angle of the second article support portion with respect to the first article support portion is from about 90° to about 135°.

7. The article holder of claim 1, wherein the angle of the second article support portion with respect to the first article support portion is from about 100° to about 120°.

8. The article holder of claim 1, wherein the angle of the second article support portion with respect to the first article support portion is about 105°.

9. The article holder of claim 1, wherein the first mounting structure comprises a first pair of engagement hooks configured to simultaneously engage a horizontal rung of the dishwasher rack.

10. The article holder of claim 9, wherein the second mounting structure comprises a second pair of engagement hooks configured to simultaneously engage a horizontal rung of the dishwasher rack.

11. The article holder of claim 10, wherein the first pair of engagement hooks are open in a direction extending substantially parallel to the second article support portion and the second pair of engagement hooks are open in a direction extending substantially parallel to the first article support portion.

12. The article holder of claim 1, wherein the first mounting structure and the second mounting structure are both attached to the first article support portion.

13. The article holder of claim 1, wherein the first article support portion extends a first width from the second article support portion and the second article support portion extends a second width from the first article support portion, wherein the first width is greater than the second width.

14. A method of installing the article holder of claim 1 to a dishwasher rack comprising the steps of:

providing a dishwasher rack having a side wall with a first portion and a second portion; and positioning the article holder in a first orientation with the first article support portion extending away from the side wall by engaging the first mounting structure with the first portion of the side wall and engaging the second article support portion with the side wall.

15. The method of claim 14, further comprising moving the article holder from the first orientation to a second orientation with the second article support portion extending away from the side wall by engaging the second mounting structure with the second portion of the side wall with the first article support portion extending along the side wall.

16. The article holder of claim 1, wherein the first portion of the dishwasher rack includes a first horizontal rung and the second portion of the dishwasher rack includes a second horizontal rung.

* * * * *